United States Patent [19]

Morris

[11] Patent Number: 4,497,094

[45] Date of Patent: Feb. 5, 1985

[54] CHILD PROOF SEAT BELT

[76] Inventor: Roy E. Morris, Route 2, Box 149, Cedar Creek, Tex. 78612

[21] Appl. No.: 444,674

[22] Filed: Nov. 26, 1982

[51] Int. Cl.[3] ..... A44B 17/00

[52] U.S. Cl. ..... 24/633; 70/55; 70/56; 70/159; 220/284

[58] Field of Search ..... 70/158, 163, 166, DIG. 34, 70/54, 55, 56, 455; 220/284, 285, 286; 297/468

[56] References Cited

U.S. PATENT DOCUMENTS

| | | | |
|---|---|---|---|
| 1,239,704 | 9/1917 | Lee et al. | 220/284 |
| 1,291,993 | 1/1919 | Matthews | 70/55 |
| 1,600,761 | 9/1926 | Haase | 220/284 |
| 2,716,882 | 9/1955 | Gill et al. | 70/159 |
| 3,343,384 | 9/1967 | Barr | 70/159 |
| 3,475,934 | 11/1969 | Reisner | 70/455 X |
| 3,718,014 | 2/1973 | Delgadillo | 70/56 |
| 4,014,080 | 3/1977 | Caradec | 297/468 X |

*Primary Examiner*—William E. Lyddane
*Assistant Examiner*—Peter A. Aschenbrenner
*Attorney, Agent, or Firm*—Peter J. Murphy

[57] ABSTRACT

An automobile seat belt includes a latch tongue fixed to one belt segment and having a latching aperture, and a latch housing fixed to the other belt segment, having a recess and opening at its distal end to receive the latch tongue. The tongue is automatically latched within the housing by insertion; and the tongue is released by depressing a release button through an opening in the top face of the latch housing. To render the seat belt child proof, a safety sleeve is slipped over the latch housing, the sleeve having one end partially closed to pass the latch tongue and the sleeve having a limited access opening in one face to overlie the release button. The sleeve is retained in enclosing position on the housing by the latch tongue. The limited access opening may be a small opening only large enough to pass the tip of the ignition key to depress the release button and unfasten the belt. The limited access opening may be larger with the housing having means for retaining a child proof safety cap of the type employed for prescription and nonprescription drugs.

20 Claims, 8 Drawing Figures

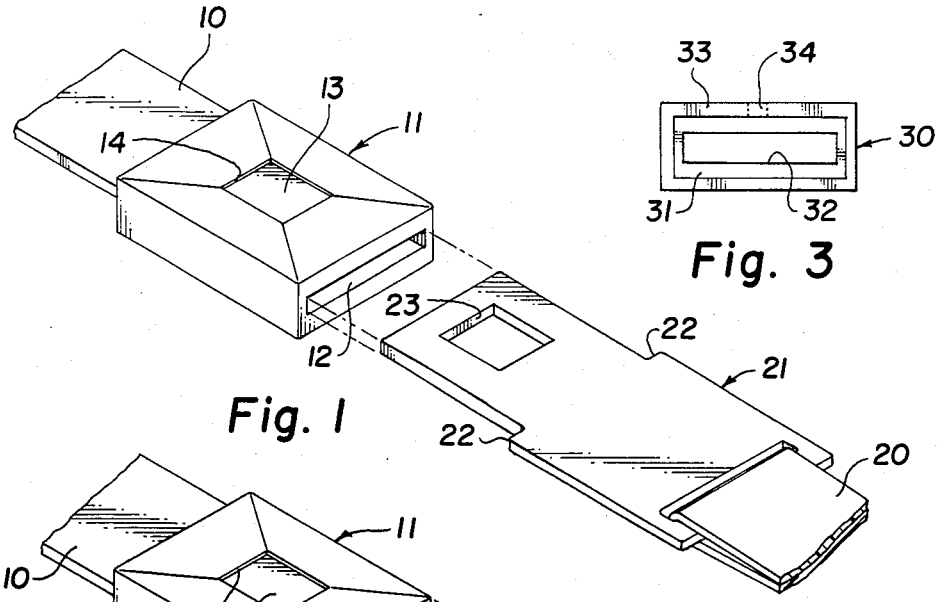
Fig. 1
Fig. 3
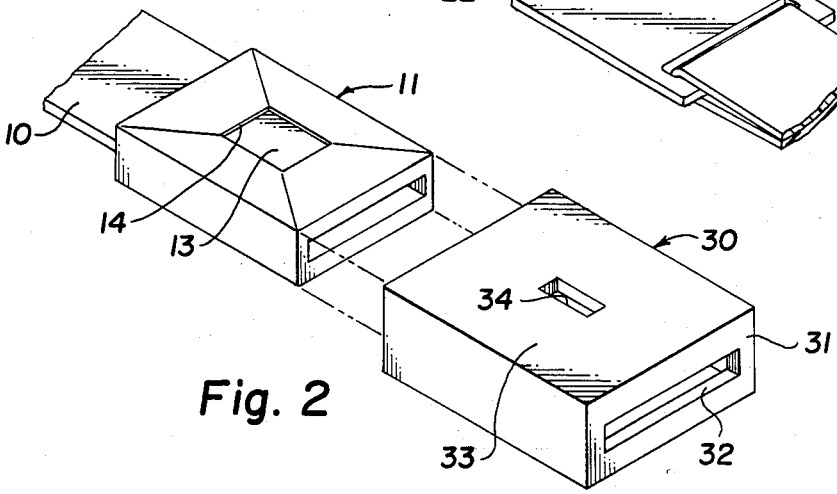
Fig. 2
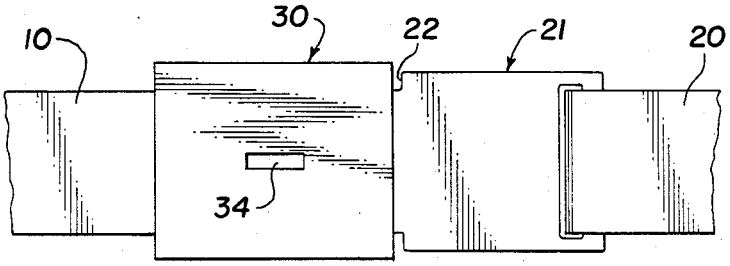
Fig. 4
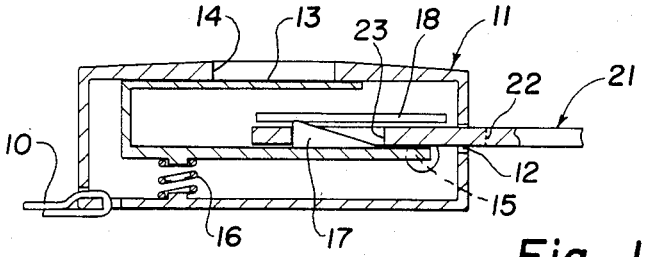
Fig. 1a

CHILD PROOF SEAT BELT

This invention relates to an automobile safety belt for small children; and more particularly to a standard automobile seat belt including an attachment for preventing the unfastening of the belt by a small child.

A standard automobile seat belt consists of a latch housing fixed to one of the belt segments and a latch element fixed to the other of the belt segments to be inserted into the latch housing to be automatically latched therein for the fastening of the seat belt. To release the latch and unfasten the seat belt, a spring loaded release button is exposed to one face of the latch housing to be depressed by the belt user or other occupant of the automobile.

When small children reach the age to travel in automobiles and be fastened with the seat belts in the usual manner, they learn very soon the function of the belt release button and have the ability, at a very early age, to depress the release button and release themselves from the seat belt. As children are very wont to do, they will stand up and likely climb around the automobile; and this can be dangerous for the children in the event of swerves or stops and particularly of course in the event of a collision.

It is very desirable, therefore, to have some means to prevent young children from unfastening the standard automobile seat belt, which means may be used readily for the purpose of securing a child in an automobile seat, and which will not interfere with the normal use of the seat belt by an adult.

An object of this invention is to provide an attachment for use with a standard seat belt for substantially preventing the unfastening of the seat belt by a child.

Another object of this invention is to provide such attachment for a standard seat belt for use when a child is to secured in an automobile seat, and which will enable normal functioning of the seat belt for use by an adult.

A further object of this invention is to provide such attachment for an automobile seat belt which is simple in design and economic to manufacture.

Still another object of this invention is to provide a method for rendering child proof a standard automobile seat belt.

These objects are accomplished in a safety sleeve for use with a standard seat belt which includes a latch housing fixed to one belt segment and a latch tongue fixed to the other belt segment. The latch tongue has a latching aperture and is configured to be received within the latch housing. The latch housing includes a spring biased latching dog for latching engagement with the tongue aperture, and release button exposed to one face of the latch housing to effect release of the latching dog from the latching aperture, the safety sleeve is dimensioned to enclose the latch housing relatively closely, having one partially closed end provided with an aperture to pass the latch tongue. The sleeve has a limited access aperture disposed to overlie the housing release button in the housing enclosing condition, the limited access aperture providing limited access to the release button to effect the release of the latch tongue and the unfastening of the belt.

The objects are accomplished also in a method for rendering child proof such standard automobile seat belt which includes the following steps. The latch housing is enclosed by a close fitting sleeve. A partially closing wall is formed at one end of the sleeve, defining an opening to pass the belt tongue. A limited access opening is formed in one wall of the sleeve, disposed to overlie the housing release button when the sleeve encloses the housing. The limited access opening limits access to the release button to effect unfastening of the seat belt.

The novel features and the advantages of the invention, as well as additional objects thereof, will be understood more fully from the following description when read in connection with the accompanying drawings.

DRAWINGS

FIG. 1 is a perspective view of a typical seat belt with separated latch housing and latch tongue;

FIG. 1*a* is a longitudinal sectional view of the latch housing;

FIG. 2 is a perspective view of the latch housing of FIG. 1 and a separated housing sleeve;

FIG. 3 is an end view of the latch housing sleeve, as viewed from the open end;

FIG. 4 is a top view of a latched latch housing and latch tongue, with the housing enclosed by the sleeve of FIGS. 2 and 3;

DESCRIPTION OF THE PREFERRED EMBODIMENT

Figure 5:
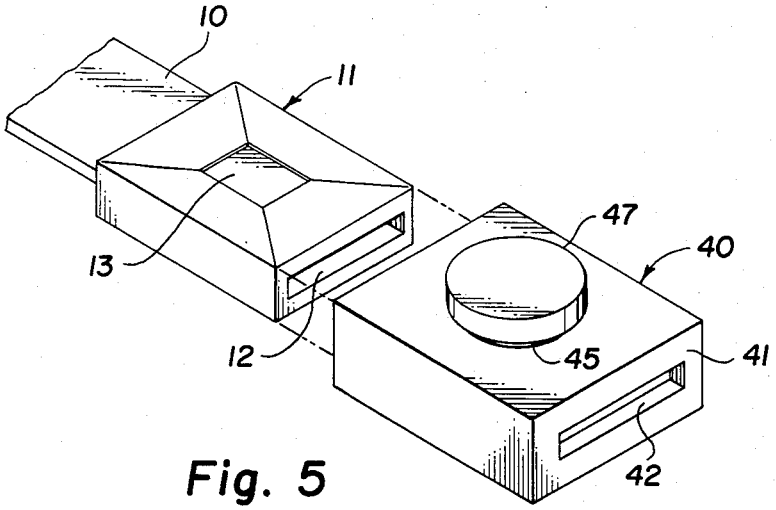
FIG. 5 is a perspective view of a latch housing and alternative form of housing sleeve, shown separated from the housing.

FIG. 1 of the drawing illustrates a typical conventional seat belt of the type installed in passenger automobiles. The latching members of the seat belt include a latch housing 11 fixed to one segment 10 of the seat belt, and a latch tongue 21 fixed to the other segment 20 of the seat belt. Typically the latch housing 11 is generally rectangular in shape, being attached to the belt segment 10 at one end, and having a recess 12 at the other end for receiving a portion of the tongue 21. The tongue 21 is a flat member including a wider portion at its proximal end which is attached to the belt segment and a narrower portion at its distal end to be received in the housing recess 12, and forward facing shoulders 22 between the distal and proximal portions. The tongue is provided with a rectangular latching aperture 23 in the distal portion, adjacent to its distal end.

A latching mechanism within the latch housing 11 which coacts with the latching aperture 23, includes a spring biased dog to be received in and engage the latching aperture 23 and a release button 13 to effect disengagement of the latching dog from the tongue aperture 23. The release button is exposed to the upper face of the latch housing 11 which is provided with an opening 14 and dimensioned to readily pass the finger of an adult user to depress the button 13. In actual construction, a single movable member within the latch housing may include the latching dog, and also include an element which defines the so-called push button 13 which coacts with the opening 14.

FIG. 1*a* illustrates such a mechanism, FIG. 1*a* being a longitudinal sectional view through the latch housing 11, with the tongue 21 inserted therein. It will be seen in FIG. 1*a* that the member 13, which defines the push button, is a U-shaped member having an upper leg which is urged against the upper housing wall closing the recess 14. The lower leg of this U-shaped member is provided with laterally opposed ears 15 which function as journals seated in suitable bearing recesses within the housing 11 providing a pivot mounting for the member 13. A biasing spring 16 urges the member 13 to the illustrated position which is the normal position. A wedge-shaped dog 17 projects upwardly from the lower leg of the member 13. Ribs 18, fixed to the side walls of the housing 11, provide stops to limit upward movement of the tongue 21 when inserted into the housing.

It will be seen that when the tongue 21 is inserted into the opening 12 of the housing, it is guided between the lower leg of the member 13 and the ribs 18. When the distal end of the tongue engages the dog 17 the member 13 is cammed downwardly allowing the distal end of the tongue to pass over the dog; and the spring 16 will then urge the member upwardly to move the dog 17 into the aperture 23 in the illustrated latched position.

It will be seen further that by depressing the release button 13, that entire member will be pivoted downward about the journal ears 15 releasing the lug 17 from the tongue to allow unfastening of the seat belt. As seen in FIGS. 1 and 1*a*, the so-called release button 13 is within the recess 14 and thereby protected to prevent accidental release and fastening of the seat belt.

FIGS. 2 and 3 illustrate a safety sleeve 30 to be used in association with the above described latch housing 11. This sleeve is generally rectangular in shape having one partially closed end 31 provided with a slot 32 dimensioned to readily pass the distal narrower end portion of the tongue 21, and having a top wall 33 provided with a small elongated slot 34 at about the center thereof. The sleeve is fabricated to have relatively stiff walls; and is readily adapted to be fabricated very economically from a plastic material by injection molding.

The sleeve is configured to be slipped over the latch housing 11 from its distal end; and is dimensioned to receive the latch housing in relatively close fitting relation. When the sleeve 30 fully encloses the housing 11, its end wall 31 will be against the distal end of the sleeve housing; and the small elongated slot 34 will be disposed in overlying relation to the push button 13.

It will be seen that the area of the slot 34 is much smaller than that of the opening 14 for the push button; and this opening 34 is configured to provide a limited access release aperture, functioning to limit the means by which the release button 13 may be depressed with the sleeve in operative position as illustrated in FIG. 4. Actually, the slot 34 in FIG. 2 is configured and dimensioned to conveniently receive the tip of the automobile ignition or door key which, of course, is conveniently available for use when desired to effect the unfastening of the seat belt by release of the seat belt latch.

As mentioned, the material of the sleeve 30 is preferably relatively stiff so that the release button 13 may not be pressed merely by exerting sufficient external pressure on the sleeve in the area of the slot 34. Since the release button is recessed relative to the upper face of the latch housing, it is most unlikely that the seat belt could be unfastened in this manner.

FIG. 3 illustrates the assembled and latched seat belt, with the sleeve 30 in operative position enclosing the latch housing 11. It will be seen that the shoulders 22 of the latch tongue 21 maintain the sleeve in the correct position with the limited access slot 34 overlying the release button.

The limited access release aperture 34 is illustrated as an elongated slot by way of example. This small aperture may have other shapes which would enable the release button to be depressed by insertion of the narrow tip of any suitable implement. It is apparent that this safety sleeve will be very effective for use with a very young child who would be unable to manage an implement for releasing the seat belt. Even when the child is older and acquires the capability for releasing the belt with a suitable implement, this seat belt assembly will still be very effective simply by preventing the child from having access to such an implement.

Figure 6:
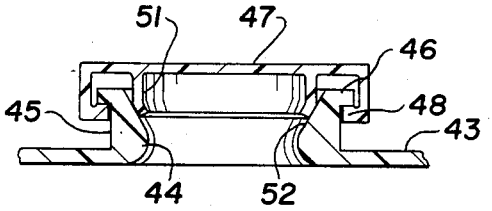
FIG. 6 is a fragmentary sectional view of the top wall of the housing sleeve, showing the access opening and cap.
Figure 7:
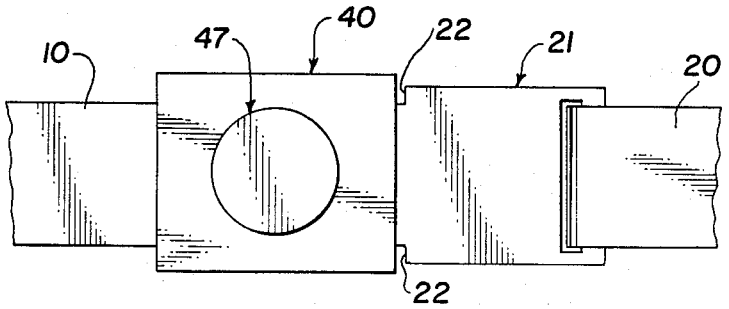
FIG. 7 is a top view of a latched latch housing and latch tongue, with the housing enclosed by the sleeve of FIGS. 5 and 6.

FIGS. 5, 6 and 7 of the drawing illustrate another form of safety sleeve 40 for use with the seat belt illustrated in FIG. 1. The sleeve 40 has a body of the same rectangular configuration illustrated in FIGS. 2 and 3, including an end wall 41 having an elongated slot 42 dimensioned to pass the smaller distal portion of the belt latch tongue 21.

A limited access release aperture 44 provided in the top wall 43 of the sleeve is much larger than the aperture previously described, being large enough to pass the finger of an adult user of the seat belt. A peripheral neck 45 is associated with and surrounds the aperture 44 and is provided with latching lugs 46 for coaction with complementary latching lugs 48 provided on the skirt of a coacting closure cap 47. The neck 45 and its associated lugs 46 and the cap 47 and its associated lugs 48 have configurations similar to that which might be provided on vials for either prescription or nonprescription drugs having safety caps for preventing of access by small children. The coacting neck 45 and closure cap 47 are illustrated and described in detail in U.S. Pat. No. Re. 30,625 issued May 26, 1981; and that patent is incorporated herein by reference. As illustrated in FIG. 6, the parts are preferably fabricated from plastic; and a biasing force tending to urge the cap upward relative to the neck is provided by the coaction of an annular wall 51 dependent from the cap 47 and coacting with the annular beveled internal surface 52 of the neck 45. The latching lugs 46 and 48 coact to prevent rotation of the cap, unless the cap is moved axially downward relative to the housing wall 43 against the biasing force provided by the member 51 and surface 52. The coaction of the cap 47 with the neck 45 renders the aperture 44 a limited access aperture with respect to small children.

The above described seat belt and safety seat assemblies are examples of apparatus which may be used for practicing a method to render child proof a standard automobile seat belt. A method for accomplishing that result includes broadly the steps: enclosing the seat belt latch housing with a close fitting sleeve; forming a closing wall at one end of said sleeve with an opening configured to pass the latch tongue of the belt; and forming a limited access opening in one sleeve wall disposed to overlie the latch housing release button when the sleeve is enclosing the latch housing, whereby that limited access opening provides limited access to the release button to enable the release thereof.

More particularly the method includes configuring the limited access opening to pass the small tip of an implement for depressing the release button, being configured as a small slot for example to pass the tip of an automobile key. Also, more particularly, the method may include forming neck means in association with the limited access opening of the latch housing to support and retain a child proof closure cap; and closing that opening with a child proof closure cap.

What has been described is a novel apparatus and method for providing a seat belt which is safe for young children since it inhibits or prevents the unfastening of the seat belt by a child.

A particular feature and advantage of the invention is that the apparatus and method involves the use of a simple attachment which may be added to the seat belt assembly for use in securing a child in an automobile, and which is not used when the belt is used in the normal fashion to secure an adult. The attachment may be readily stored in the glove compartment or other convenient place for use when desired.

Another important feature and advantage of the invention is that the attachment for the seat belt assembly is very easily and readily assembled with the seat belt for use to secure a child, is very effective for that purpose, and that the seat belt is very readily and easily unfastened by an adult when desired.

While the preferred embodiments of the invention have been illustrated and described, it will be understood by those skilled in the art that changes and modifications may be resorted to without departing from the spirit and scope of the invention.

What is claimed is:

1. For use with a seat belt which includes a latch housing and a coacting latch tongue fixed to respective seat belt segments; said latch tongue being insertable in said latch housing to fasten said seat belt, and said latch housing having an end opening to pass said latch tongue; said latch housing having a release button exposed to one face thereof, dimensioned to be depressed by a thumb or finger to release said latch tongue from said latch housing;

a safety cover for enclosing said release button in said one housing face; said cover having a release aperture disposed to overlie only a small portion of said release button; said release aperture enabling depression of said release button only by an instrument dimensioned to pass through said release aperture.

2. Apparatus as set forth in claim 1 said release aperture comprising a small aperture configured to pass the small tip of an instrument used to depress said release button.

3. Apparatus as set forth in claim 1 said release aperture comprising a small elongated slot configured to pass the tip of an automobile key.

4. Apparatus as set forth in claim 1 said safety cover being fabricated from a material sufficiently stiff to prevent depressing said button by means of said cover.

5. Apparatus as set forth in claim 1 said safety cover comprising a sleeve-like body configured to enclose said latch housing, having one end wall provided with an aperture dimensioned to pass said latch tongue into and out of said housing;

said body having said release aperture, disposed to overlie said release button when said body encloses a latch housing.

6. A safety cover as set forth in claim 5 for use with a seat belt having a latch tongue which includes a wider proximal portion attached to the belt and a narrower distal portion receivable in said latch housing;

said aperture in said cover end wall being dimensioned to pass only the narrower distal portion of said latch tongue into and out of said housing, whereby said cover is retained in its housing enclosing position by said latch tongue when the seat belt is fastened.

7. A safety cover as set forth in claim 5 said release aperture being dimensioned to pass the finger of a user to depress said release button;

said cover body having projecting neck means at the periphery of said release aperture for supporting a closure cap; and said neck means and said closure cap having coacting child proof closure means to make difficult the opening of said closure cap by a small child.

8. A method for rendering child proof a standard automobile seat belt which consists of a latch housing fixed to one belt segment and a latch tongue fixed to the other belt segment, said tongue being insertable in said housing to effect automatic fastening of the belt; said housing having a release button exposed to one face thereof, dimensioned to be depressed by a thumb or finger to effect release of the tongue from the housing; the method comprising the steps enclosing said release button in said one housing face with a safety cover;

forming a release aperture in said cover disposed to overlie only a small portion of said release button; said release aperture enabling depression of said release button only by an instrument dimensioned to pass through said release aperture.

9. A method as set forth in claim 8, including configuring said release aperture to pass the small tip of an instrument used for depressing said release button.

10. A method as set forth in claim 8, including configuring said release aperture as a small elongated slot dimensioned to pass the tip of an automobile key.

11. A method as set forth in claim 8, including fabricating said cover from a material sufficiently stiff to prevent depressing said button by means of said cover.

12. A method as set forth in claim 8 including enclosing said housing with a relatively close fitting sleeve-like cover having one end wall, said sleeve-like cover defining said safety cover;

forming an aperture in said cover end wall configured to pass said latch tongue;

forming said release opening in one cover wall disposed to overlie said housing release button when said cover encloses said housing.

13. A method as set forth in claim 12, including forming projecting neck means on said cover around the periphery of said release opening for supporting a closure cap;

forming coacting closure means in said neck means and said closure cap configured to make difficult the removing of said closure cap by a small child.

14. In combination with a seat belt which includes a latch housing and a coacting latch tongue fixed to respective seat belt segments; said latch tongue being insertable in said latch housing to fasten said seat belt, said latch housing having a release button exposed to one face thereof, dimensioned to be depressed by a thumb or finger to release said latch tongue from said latch housing;

a safety cover for enclosing said release button in said one housing face; said cover having a release aperture disposed to overlie only a small portion of said release button; said release aperture enabling depression of said release button only by an instrument dimensioned to pass through said release aperture.

15. Apparatus as set forth in claim 14 wherein said latch housing has an end opening to pass said latch tongue;

said safety cover comprising a sleeve-like body configured to enclose said latch housing in relatively close fitting relation; said cover having one end wall provided with an aperture dimensioned to pass said latch tongue into and out of said housing end opening;

said cover body having said release aperture, disposed to overlie said release button when said cover encloses said housing.

16. Apparatus as set forth in claim 15 said latch tongue having a proximal portion fixed to its respective belt segment and a narrower distal portion receivable in said latch housing;

and said safety cover end aperture being dimensioned to pass only said distal portion of said latch tongue.

17. Apparatus as set forth in claim 14 said release aperture comprising a small aperture configured to pass the pointed tip of an instrument used to depress said release button.

18. Apparatus as set forth in claim 14 said release aperture comprising a small elongated slot configured to pass the tip of an automobile key.

19. Apparatus as set forth in claim 14 said release aperture being dimensioned to pass the finger of a user to depress said release button;

said cover body having projecting neck means at the periphery of said release aperture for supporting a closure cap; and said neck means and said closure cap having coacting child proof closure means to make difficult the opening of said closure cap by a small child.

20. Apparatus as set forth in claim 14 said safety cover being fabricated from a material sufficiently stiff to prevent depressing said button by means of said cover.

* * * * *